US007213875B2

(12) United States Patent
Jane Santamaria

(10) Patent No.: US 7,213,875 B2
(45) Date of Patent: May 8, 2007

(54) FOLDABLE CHAIR

(75) Inventor: Manuel Jane Santamaria, Barcelona (ES)

(73) Assignee: Jane, S.A., Barcelona (ES)

( * ) Notice: Subject to any disclaimer, the term of this patent is extended or adjusted under 35 U.S.C. 154(b) by 0 days.

(21) Appl. No.: 11/124,248

(22) Filed: May 5, 2005

(65) Prior Publication Data

US 2005/0285435 A1 Dec. 29, 2005

(30) Foreign Application Priority Data

Jun. 23, 2004 (ES) ..... 200401524

(51) Int. Cl.
*A47C 4/00* (2006.01)

(52) U.S. Cl. ..... 297/55; 297/16.1; 297/239

(58) Field of Classification Search ..... 297/16.1–16.2, 297/40–41, 48–49, 55, 59, 452.7, 183.7, 297/24–25, 22, 18, 252, 352, 377, 440.2, 297/239; D6/368, 334–336
See application file for complete search history.

(56) References Cited

U.S. PATENT DOCUMENTS 1,838,213 A * 12/1931 Buffington ..... 297/55
2,654,419 A * 10/1953 Nordmark ..... 297/58
2,713,890 A * 7/1955 Mack ..... 297/31
3,007,737 A 11/1961 Lichter
3,220,764 A * 11/1965 Duer ..... 297/56
4,298,227 A * 11/1981 Berthier et al. ..... 297/58
4,441,757 A * 4/1984 Gasca Burges ..... 297/55
4,906,042 A * 3/1990 Ollat ..... 297/19
5,503,458 A * 4/1996 Petrie ..... 297/452.13
5,927,812 A * 7/1999 Vanderminden, Sr. ..... 297/377
6,193,307 B1 * 2/2001 Lin ..... 297/58
6,257,660 B1 * 7/2001 Calvey ..... 297/16.1
6,305,742 B1 * 10/2001 Spendlove et al. ..... 297/16.1
D467,089 S * 12/2002 Wu ..... D6/368
6,543,842 B2 * 4/2003 Haney ..... 297/55
D476,495 S * 7/2003 Tsai ..... D6/368
6,662,981 B2 * 12/2003 McUmber ..... 224/155
6,877,803 B1 * 4/2005 Reese ..... 297/18
6,883,862 B1 * 4/2005 Yao ..... 297/16.1
7,021,705 B1 * 4/2006 Niermeyer et al. ..... 297/55

FOREIGN PATENT DOCUMENTS

EP 0 077 871 5/1983

* cited by examiner

*Primary Examiner*—Rodney B. White
*Assistant Examiner*—Erika Garrett
(74) *Attorney, Agent, or Firm*—Jordan and Hamburg LLP

(57) ABSTRACT

This foldable chair comprises a frame forming the backrest and the forward prop and being articulately linked to a second frame forming the backward prop and to a plate forming the seat. A characterising feature lies in that the seat is linked in a pin-jointed connection and by means of a link to the second frame, said link having each of its respective ends linked in a pin-jointed connection to the respective one of two pieces being fixedly attached to the lower surface of the seat and to the lower surface of the cross member of the second frame, respectively, the seat coming to rest on this latter cross member.

10 Claims, 1 Drawing Sheet

FOLDABLE CHAIR

FIELD OF THE INVENTION

This foldable chair has been devised for the purpose of being preferentially used by infants.

BACKGROUND OF THE INVENTION

There are different models of foldable chairs for infants, said foldable chair models generally having a simple makeup and for example including among them the one being made up by a frame making up the backrest and the forward prop and being articulately linked to a second frame making up the backward prop and to a plate making up the seat and coming to rest on the second frame.

A drawback of this type of chairs lies in that because of having their components articulately linked to each other their folded arrangement is not stable, the articulated members effecting relative motions with respect to each other and thus hampering the handling of these chairs when having to move them around and put them aside.

SUMMARY OF THE INVENTION

This invention has as its object a foldable chair which once folded maintains its components, i.e. the two frames and the seat, in a mutually juxtaposed arrangement thus forming a compact assembly allowing to more easily move it around and put it aside in the dealer's warehouse or in the user's home.

This foldable chair is characterised in that the seat is linked in a pin-jointed connection and by means of a link to the second frame forming the chair's backward prop.

In order to establish this pin-jointed connection a piece is fixedly attached to the lower surface of the seat and another piece is also fixedly attached to the lower surface of the cross member of the second frame, said seat coming to rest on this latter cross member, each of the respective ends of the link being linked in a pin-jointed connection to the respective one of the aforementioned pieces, said link longitudinally having a slightly arcuate shape and being forked at its ends.

These and other features will be best made apparent by the following detailed description whose understanding will be made easier by the accompanying sheet of drawings showing a practical embodiment being cited only by way of example not limiting the scope of the present invention.

DETAILED DESCRIPTION

Figure 2:
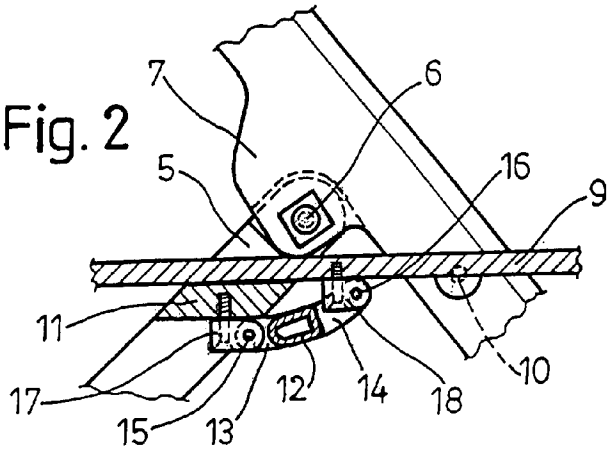
FIGS. 2, 3 and 4 in a sectional elevation illustrate the detail of the pin-jointed connections between the three components of the chair in the unfolded, semi-unfolded and folded positions, respectively.

According to the drawings this foldable chair comprises a rectangular frame 1 at its upper end forming the backrest 2 and at its lower end forming the forward prop 3; a second rectangular frame 4 forming the backward prop 8 of the chair and having extended sides 5 being each by means of a pin 6 linked in a pin-jointed connection to the respective projection 7 of the backward edge of each of the sides of frame 1; and a quadrangular plate 9 forming the seat of the chair and being laterally linked in a pin-jointed connection and by means of a pin 10 to the sides of frame 1.

Figure 1:
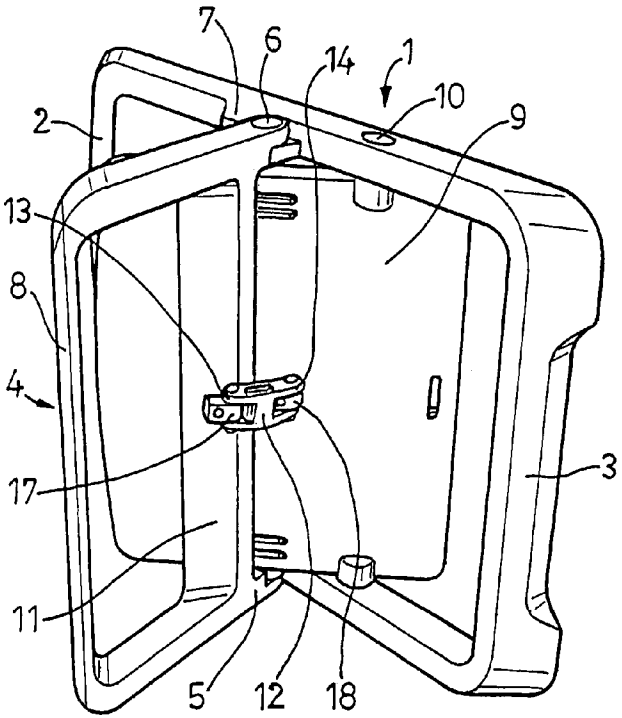
FIG. 1 shows in a perspective view the chair being the object of the invention, said chair being shown here in its unfolded state and as seen from below.

In the chair's unfolded position the seat plate 9 rests on the upper cross member 11 of frame 4 (FIGS. 1 and 2).

In the chair's folded position (FIG. 4) the seat plate 9 is in the plane of frame 1 and frame 4 is juxtaposed on said frame 1.

In order to maintain the chair in a stably folded position the seat 9 is linked in a pin-jointed connection with the second frame 4 by means of a link 12 longitudinally having a slightly arcuate shape and being forked at its ends 13 and 14, each of said ends by means of a respective pin 15 and 16 being linked in a pin-jointed connection to a respective piece 17 and 18 being fixedly attached to the lower surface of the cross member 11 and to the lower surface of the seat 9, respectively.

Figure 4:
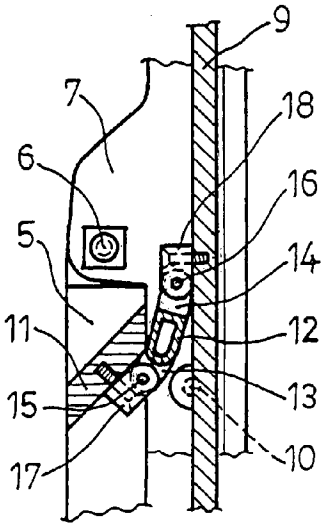
Figure 3:
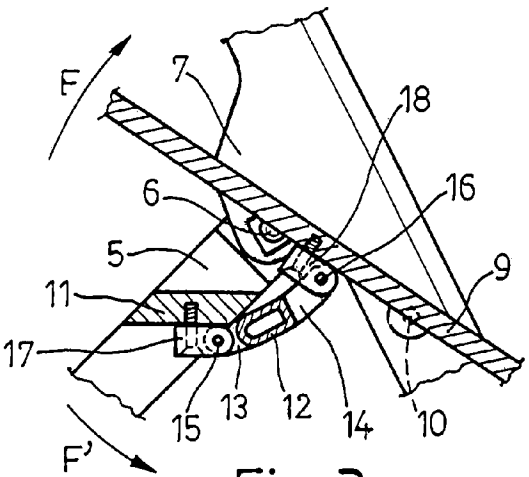

When with this structure proceeding to fold the chair, when folding the seat 9 as per arrow (F) around the pin 10 said seat by means of the link 12 will pull along the frame 4 as per arrow (F') till finally reaching a position wherein the three components of the chair are arranged in a juxtaposed and stabilised arrangement as shown in FIG. 4.

A tray can be also fitted to this chair.

The invention claimed is:

1. A foldable chair comprising:

a first frame member forming a backrest and a forward prop;

said first frame member being articulately linked to a second frame member forming a backward prop;

said first frame member being further articulately linked to a third member forming a seat;

said second frame member including a cross member, said seat being positionable on said cross member when said chair is unfolded;

said seat being connected to said first frame member by a pin-jointed connection; and said seat being connected to said second frame member by a link structure so that when a rear portion of said seat is rotated toward said backrest, said backward prop is biased towards said forward prop of said chair.

2. The foldable chair of claim 1, wherein said link structure further comprises:

a first link member fixedly attached to a lower surface of the seat;

a second link member fixedly attached to a lower surface of said cross member of the second frame member; and center link member having opposing ends, each of the respective opposing ends of the center link member being connected to a respective one of the first and second link members.

3. The foldable chair of claim 2, wherein the center link member has a longitudinally arcuate shape and is forked at said opposing ends.

4. A foldable chair comprising:

a first member having a top portion defining a backrest and a bottom portion defining a forward support of said chair;

a second member defining a rear support of said chair, said rear support having a top portion that is pivotally connected to said forward support of said chair;

said top portion of said rear support including a laterally extending support member, said support member having top and bottom surfaces;

a third member defining a seat having front and rear portions and top and bottom surfaces, said top surface of said front portion defining a seating surface when said chair is unfolded;

said front portion of said seat being pivotally connected to said forward support of said chair, below the connection between said forward support and said rear support;

said bottom surface of said rear portion of said seat capable of being positioned against said top surface of said support member when said chair is unfolded; and means for connecting said bottom surface of said seat to the bottom surface of said support member so that when said rear portion of said seat is rotated toward said backrest, said rear support is biased towards said forward support of said chair.

5. The foldable chair of claim 4, wherein means for connecting said bottom surface of said seat to bottom surface of said support member comprises:

a first link member fixedly attached to said bottom surface of said seat;

a second link member fixedly attached to said bottom surface of said support member; and a center link member having opposing ends, each of the respective ends of the center link member being pivotally connected to a respective one of the first and second link members.

6. The foldable chair of claim 2, wherein each of the respective opposing ends of the center link member is connected in a pin-jointed connection to the respective one of the first and second link members.

7. A foldable chair comprising:

a first frame member forming a backrest and a forward prop;

said first frame member being articulately linked to a second frame member forming a backward prop and said second frame member including a cross member;

said first frame member being further articulately linked to a member forming the seat;

said seat being connected to said first frame member by a pin-jointed connection; and said seat being connected to said second frame member by a link structure so that when a rear portion of said seat is rotated toward said backrest, said backward prop is biased towards said forward prop of said chair, said link structure further comprising:

a first link member fixedly attached to a lower surface of the seat;

a second link member fixedly attached to a lower surface of said cross member of the second frame member; and a center link member having opposing ends, each of the respective opposing ends of the center link member being connected to a respective one of the first and second link members.

8. The foldable chair of claim 7, wherein the center link member has a longitudinally arcuate shape and is forked at said opposing ends.

9. The foldable chair of claim 8, wherein said seat is positionable on said cross member when said chair is unfolded.

10. The foldable chair of claim 9, wherein each of the respective opposing ends of the center link member is connected in a pin-jointed connection to the respective one of the first and second link members.

* * * * *